United States Patent [19]

Glaser

[11] Patent Number: 4,679,684

[45] Date of Patent: Jul. 14, 1987

[54] MULTIPLE CHAMBER AUTOMATED VENDING MACHINE

[75] Inventor: Robert L. Glaser, Deerfield, Ill.

[73] Assignee: L. M. Becker & Co., Inc., Appleton, Wis.

[21] Appl. No.: 835,388

[22] Filed: Mar. 3, 1986

[51] Int. Cl.[4] ..... G07F 11/44

[52] U.S. Cl. ..... 194/350; 221/130; 221/281

[58] Field of Search ..... 221/92, 129, 130, 131, 221/155, 265, 281; 312/35, 45, 49; 194/350

[56] References Cited

U.S. PATENT DOCUMENTS

| | | | |
|---|---|---|---|
| D. 155,634 | 10/1949 | Smiley et al. | D52/3 |
| D. 194,757 | 3/1963 | Benert | D52/3 |
| D, 272,918 | 3/1984 | Glaser | D20/1 |
| 533,963 | 2/1895 | Northcutt | 221/92 |
| 1,566,175 | 12/1925 | Vaghi | 221/281 X |
| 1,873,649 | 8/1932 | Knott | 221/281 X |
| 2,176,232 | 10/1939 | Warren et al. | 221/265 |
| 2,360,573 | 10/1944 | Mena | 221/281 X |
| 2,960,373 | 11/1960 | Caruso | 221/131 X |
| 3,420,591 | 1/1969 | Schaef | 312/35 |
| 3,804,294 | 4/1974 | Householder | 221/265 X |
| 4,440,312 | 4/1984 | Glaser | 221/24 |

FOREIGN PATENT DOCUMENTS

| | | | |
|---|---|---|---|
| 344860 | 4/1960 | Switzerland | 221/92 |

*Primary Examiner*—F. J. Bartuska

*Attorney, Agent, or Firm*—Quarles & Brady

[57] ABSTRACT

A multi-chamber vending machine having an outer housing and upper and lower chambers inside the housing. The upper chamber has a bottom wall and a plurality of vertically extending walls. The lower chamber surrounds a portion of the bottom wall of the upper chamber and a portion of a vertically extending wall of the upper chamber. The machine includes a door connected to the housing, whereby both chambers may be filled by access through the door.

2 Claims, 12 Drawing Figures

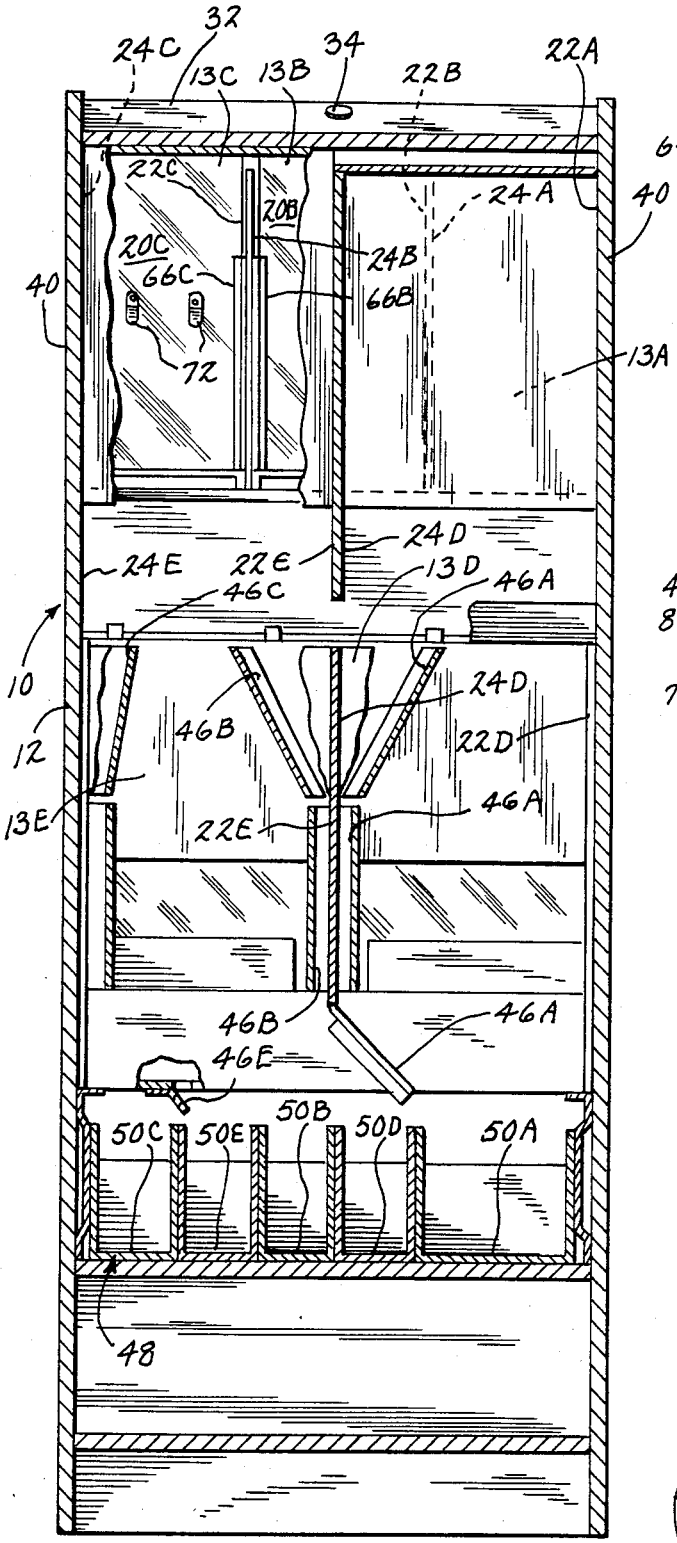
FIG. 4
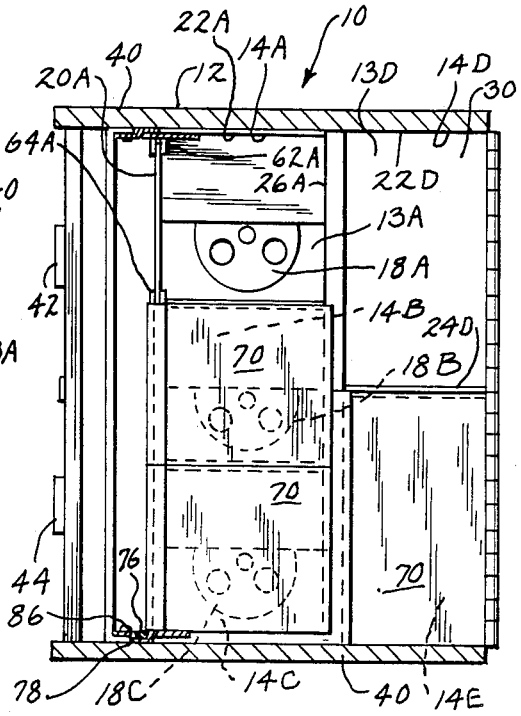
FIG. 5
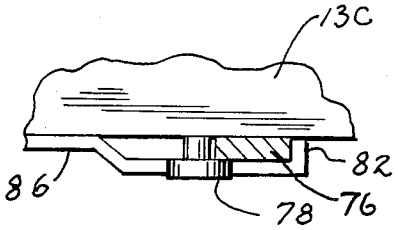
FIG. 6
FIG. 7
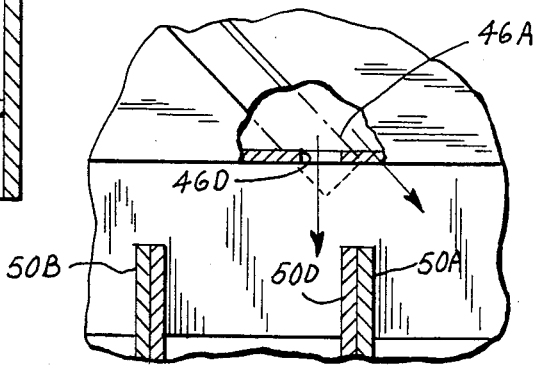

MULTIPLE CHAMBER AUTOMATED VENDING MACHINE

BACKGROUND OF THE INVENTION

This invention relates to vending machines, and, in one aspect, to a multi-chamber vending machine in which a plurality of chambers are located inside a single housing.

It is common in the art to provide a plurality of small, independent vending machines mounted together on a single structure. Each of the vending machines has its own opening for filling the machine, its own opening for vending, and its own coin collection receptacle. In order to fill these machines, an operator must therefore open one fill door for each machine, and, in order to collect the money, he or she must open one coin lock door for each machine. This procedure is time consuming and is an inefficient use of manpower.

In addition, in machines of the prior art, the chamber which holds the goods over the vending wheel is often made to be relatively small. This is due at least in part to the fact that a heavy load of articles on the wheel tends to cause the vending wheel to jam. The effect is that the machine must be filled often, thereby compounding the inefficiency in use of manpower.

A related problem in the art is the difficulty of obtaining access to the machine interior (e.g. to clear a jam or to change a display). This can be especially difficult when the machine is partially filled.

SUMMARY OF THE INVENTION

The present invention preferably provides a multi-chamber vending machine in which an upper chamber and a lower chamber are located inside an outer housing. Each of the chambers is adapted to hold a flowable body of merchandise items, and each of the chambers has a filling port for introducing the merchandise items into the chamber and a dispensing port for dispensing the items to the outside of the chamber. The lower chamber surrounds a portion of the bottom of the upper chamber and a portion of a vertically extending wall of the upper chamber. There is a vending means positioned in each of the chambers, and there is a door means connected to the housing providing an entry into the interior of the housing, whereby the filling ports for both chambers may be accessed by opening the door means.

In one embodiment, this design permits an operator to fill both upper and lower chambers by opening a single top lockable door, thereby providing more efficient use of manpower. Further, at least one removable cover can be provided which is suitable to cover at least a portion of the filling port of one of the chambers while an operator is filling the other chamber with merchandise items. This assists in preventing the merchandise from accidentally being dropped into the wrong filling port.

In another version, both of the chambers have associated therewith coin-operated triggering means for controlling the vending of the merchandise in response to coin payment, and each of the triggering means has a coin receptacle for receiving coins from outside the chamber and a coin pathway which directs coins to a coin storage area below both chambers. The storage area has a plurality of horizontally spaced coin collection boxes and a lockable door enclosure mounted on the outer housing for securing and accessing the coin storage area. In this manner, manpower can be saved because all coins can be stored in a single secure area, can be accessed through a single door, and can be separately accounted for if an audit of each machine is desired.

In addition, the vending machine of the present invention can provide an item support plate in the chamber above the merchandise dispensing means. The item support plate can support at least a portion of the weight of the merchandise items which are located above the plate in the chamber while directing the merchandise items to travel downward toward the merchandise dispensing means. The result is that a large quantity of merchandise items may be placed into the chamber during filling without applying excessive weight to the merchandise dispensing means which might otherwise cause the merchandise dispensing means to malfunction. By allowing the operator to insert more merchandise items when filling the vending machine, fewer trips must be made to the machine, thereby saving manhours.

Yet another aspect of the invention is that easy access to the chamber's interior can be provided by the front wall of the chamber. The front wall can be mounted on a pair of vertical tracks so that it can be slid upwardly even when merchandise is in the chamber. This front wall can be made transparent and clips can be mounted on the inside thereof so that a display can be retained by the clips. Easy access to other portions of the machine can be made possible by a special vertical locking bar.

The objects of the present invention therefore include:

(a) Providing a vending machine of the above kind in which loading access to the filling ports of multiple chambers is through a single door;

(b) Providing a vending machine of the above kind in which access to separately collected coins is through a single door;

(c) Providing a vending machine of the aboye kind in which manpower required to service the machine is reduced;

(d) Providing a vending machine of the above kind in which large volumes of merchandise can be stored without causing jams; and (e) Providing a vending machine of the above kind in which there is easy access to the chamber interior to clear jams and change displays.

These and still other objects and advantages of the present invention will be apparent from the description of the preferred embodiment below. These embodiments are intended only as examples and are not intended as depicting the full scope of the invention.

BRIEF DESCRIPTION OF THE DRAWINGS

FIG. 4 is a back sectional view, partially fragmented, of the vending machine taken on line 4—4 of FIG. 3;

FIG. 5 is a view taken on line 5—5 of FIG. 3 with the item support plates (62) removed;

FIG. 6 is an enlarged top sectional view of the side locking bar portion of the machine taken from FIG. 5;

FIG. 7 is an enlarged back sectional view of one of the coin slots taken from FIG. 4;

DESCRIPTION OF THE PREFERRED EMBODIMENT

Figure 1:
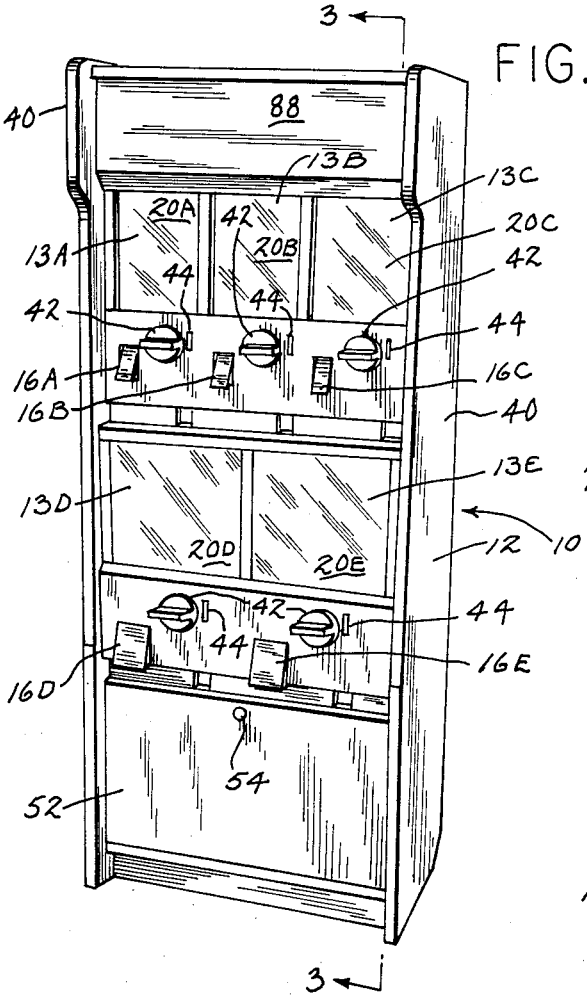
FIG. 1 is a front perspective view of a vending machine made in accordance with the present invention.

The vending machine 10 has an outer housing 12 which holds a number of vending chambers 13 (A–E). In this particular embodiment, there are three upper chambers 13 (A–C), and two lower chambers, 13 (D–E). Each chamber 13 (A–E) has a filling port 14 (A–E) and a dispensing port 16 (A–E). Each chamber also includes vending means 18 (A–E) (which can be seen in FIG. 5). The vending means 18 (A–E) may be like those described in detail as "dispensing means" in U.S. Pat. No. 4,440,312 which is hereby incorporated by reference. Each chamber has several vertically extending walls—a front wall 20 (A–E), side walls 22 (A–E), 24 (A–E), and a back wall 26 (A–E). Each chamber also has a bottom wall 28 (A–E). The lower chambers 13 (D–E) surround portions of the bottom 28 and back 26 of the upper chambers 13 (A–C). Looking at the lower chamber 13E in FIG. 3, it can be seen that the back wall 26E is located behind the back wall 26C of the upper chamber 13C. This creates a channel 30E and provides that the filling port 14E of the lower chamber 13E is located at substantially the same height as the filling port 14C of the upper chamber 13C. Likewise, the filling port 14D of the lower chamber 13D is located at the same height as the filling ports 14A and 14B of the upper chambers 13A and 13B.

Figure 9:
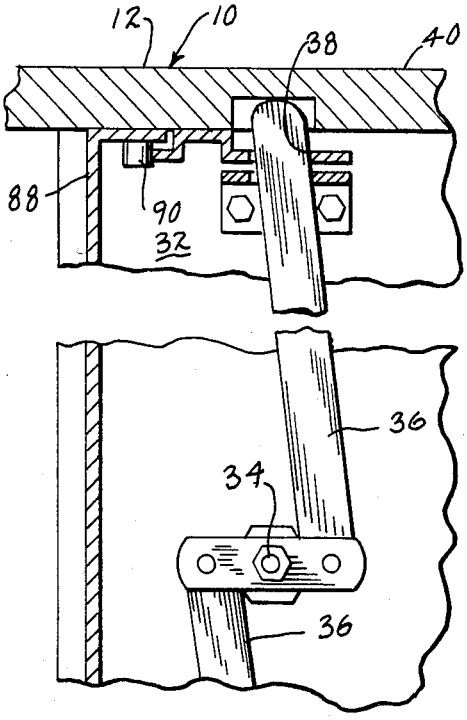
FIG. 9 is an enlarged view taken on line 9—9 of FIG. 3.

With all of the chambers being open at the top (see FIG. 5), and all the filling ports 14(A–E) located at approximately the same height near the top of the vending machine, it is possible to reach all the chambers by opening the single door 32 (shown in FIG. 2) which forms the top of the outer housing 12. The door 32 is hinged and swings open upwardly. It includes a rotatable lock 34 (see FIGS. 2 and 9) which can be opened from the outside only with a key. The lock 34 includes two arms 36 which fit into grooves 38 (see FIGS. 2 and 9) in side plates and in the side walls 40 of the outer housing 12.

Thus, an operator may fill all the upper and lower merchandise chambers 13 (A–E) simply by opening the door 32 and inserting the items into their respective filling ports 14 (A–E). This is a considerable time saving over the older method of opening each chamber separately and filling each chamber individually. Although a single door is preferred, it may be more convenient in some cases to have more than one door, i.e., one door for the upper chambers and another door for the lower chambers.

Figure 2:
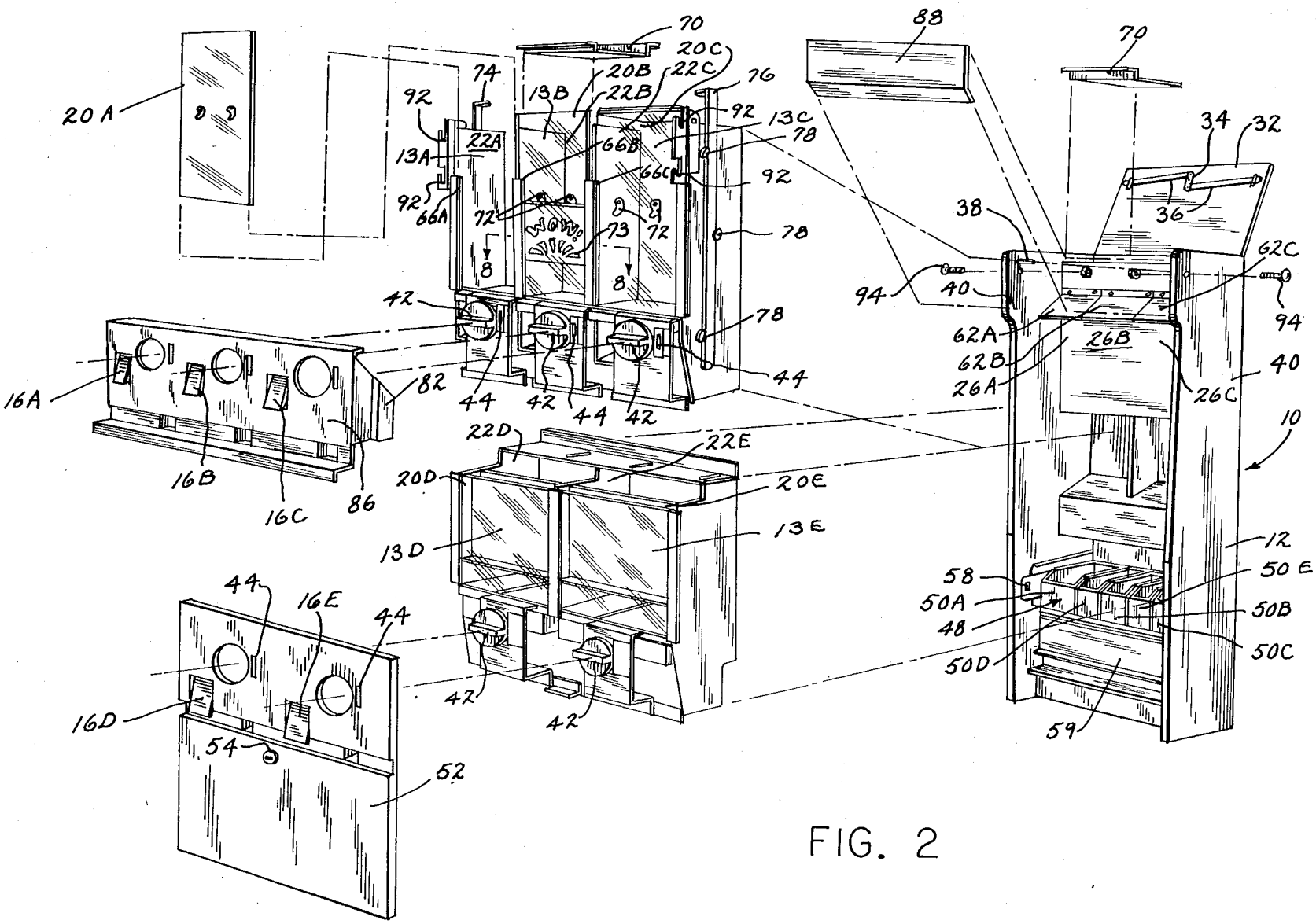
FIG. 2 is an exploded perspective view of the vending machine of FIG. 1.
Figure 10:
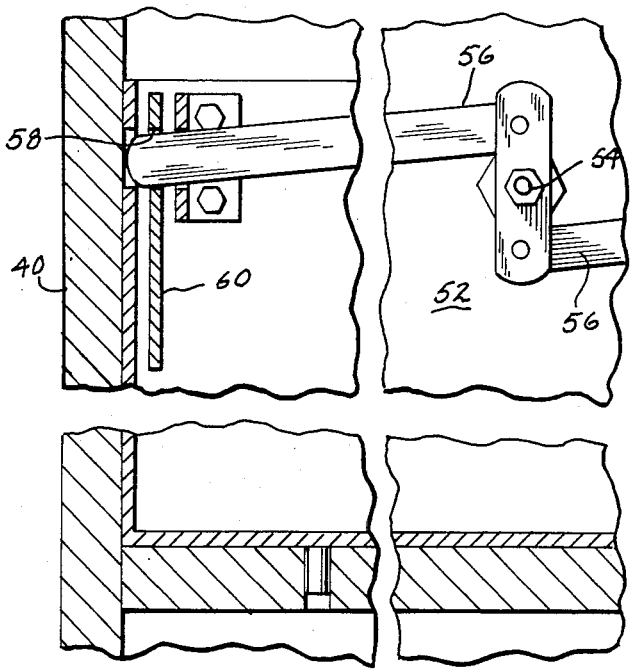
FIG. 10 is an enlarged view taken on line 10—10 of FIG. 3.

As best seen in FIGS. 2 and 4, each of the vending means 18A through 18E includes a coin-operated triggering means 42 having a coin receptacle 44. In addition, each of the chambers 13 (A–E) includes a coin pathway 46 (A–E) which directs the coins to a coin storage area 48 located below the upper and lower chambers 13 (A–E). The coin storage area 48 includes a plurality of horizontally-spaced coin collection boxes 50 (A–E), and each collection box 50 is located below a single coin pathway 46 so that the coins received from each chamber 13 (A–E) are segregated in their respective collection boxes 50 (A–E). As best shown in FIGS. 2 and 10, this single coin storage area 48 is enclosed by an outer door 52 which includes a keyed lock 54 including arms 56 which fit into slots 58 on each side of the vending machine. The slots 58 are located in plates 60 which are bolted to the sides 40 of the vending machine 10.

Figure 3:
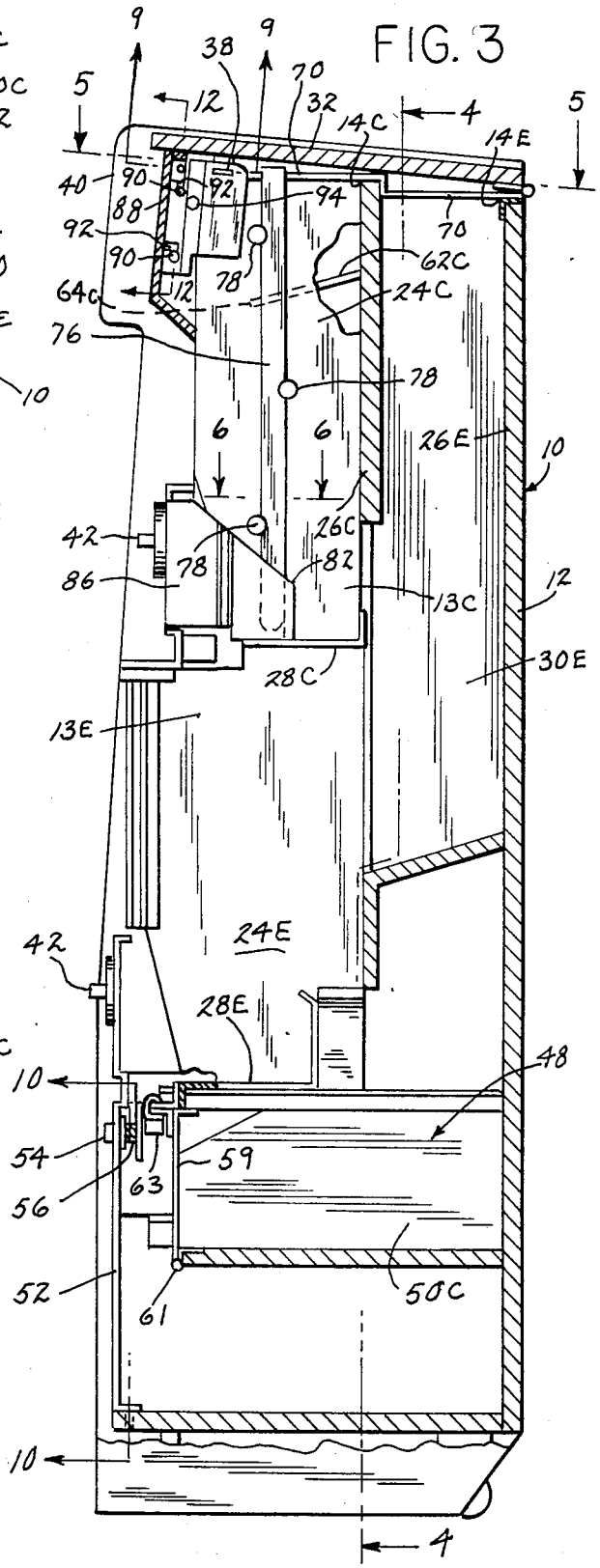
FIG. 3 is a side sectional view, partially fragmented, of the vending machine taken along the line 3—3 of FIG. 1.
Figure 11:
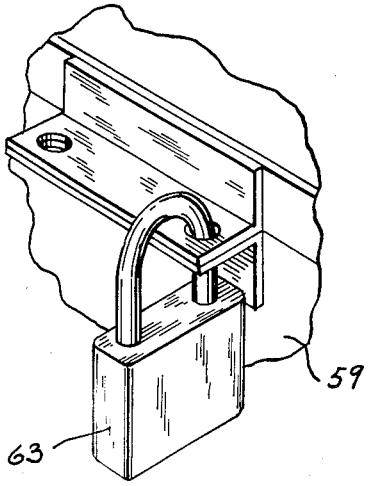
FIG. 11 is an enlarged, broken-away perspective view of the inner coin door locking mechanism shown in FIG. 3.

There may also be an inner coin lock door 59 which is hinged along the hinge 61. The door 59 is shown closed in FIG. 3 and open (or swung down) in FIG. 2. The inner coin door 59 may be locked by a padlock as shown in FIGS. 3 and 11.

Looking in particular at the upper chamber 13C, it can be seen that this chamber, like the others, has its vending means 18C positioned in the lower end of the chamber. An item support plate 62C (shown in FIG. 3) is positioned part-way up the chamber 13C above the vending means 18C and serves to support at least part of the weight of the merchandise items which are located above the plate 62C in the chamber 13C. The item support plate 62C is fastened to the back wall 26C by screws and contacts the back wall 26C and side walls 22C, 24C. The plate 62C is spaced from the front wall 20C and is inclined downward from back to front so as to direct the merchandise items downward through the gap 64C between the plate 62C and the front wall 20C toward the vending means 18C.

Figure 8:
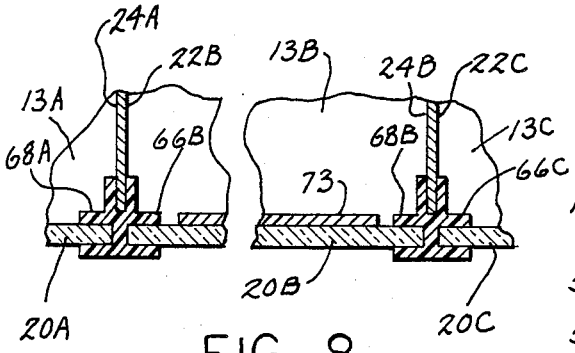
FIG. 8 is an enlarged view taken on line 8—8 of FIG. 2.

Looking at the upper chambers 13B, particularly in FIG. 8, it can be seen that the side walls 22B, 24B define opposed vertical tracks 66B, 68B, and the front wall 20B can ride in those tracks. Therefore, it is possible to get into the upper chamber 13B not only through the filling port 14B, but also by sliding the front wall 20B upward in the tracks. This means of access can be very useful for reaching the lower part of the chamber 13B, in case the vending means 18B is jammed or needs maintenance, or in case a display in the chamber needs to be changed.

The front walls 20 (A–E) of all the chambers are transparent. As shown in FIG. 2, on the inside of the front walls 20B and 20C are riveted clips 72 which can be used to retain items such as promotional material 73 against the transparent front walls.

On top of some of the filling ports 14 (A–E) and below the door 32 are removable covers 70 which can be moved around in order to close off some filling ports 14 when filling others. This permits the person who is filling the vending machine to simply open the door 32 and pour the flowable merchandise items into their respective chambers without fear of spilling the items into the wrong chambers. Three removable covers 70 are shown. However, the number may vary according to the operator's preference.

As shown in FIGS. 2, 3, 5, and 6 vertical locking bars 74, 76 are provided between the inside of the side walls 40 of the outer housing 12 and the outside of the side walls 22A and 24C. These vertical locking bars 74, 76 slide up and down in their respective tracks which are defined by pins 78. When they are lowered downward, the locking bars 74, 76 catch lips 82 of the outer housing plate 86 (see FIG. 2), thereby retaining the plate 86 on the vending machine 10. To remove the plate 86, the vertical locking bars 74, 76 can be slid upward, and the plate 86 is released. Thus, access to yet another portion of the machine is readily obtainable.

Figure 12:
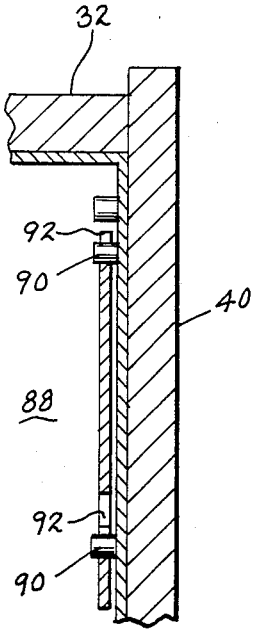
FIG. 12 is an enlarged, broken-away sectional view taken on the line 12—12 of FIG. 3, showing the means for attaching an upper panel to the machine.

The upper frontal plate 88 in the outer housing is held in place by means of pins 90 (see FIGS. 3 and 12) on the plate 88 which fit into hooks 92 which are bolted to the inside of the sides 40 of the outer housing. Thus, when the door 32 is open, the upper plate 88 may be removed simply by lifting it up so that the pins 90 are released from the hooks 92. The three upper chambers 13 (A–C) can then be removed by removing one bolt 94 on each side 40 of the outer housing.

It will be obvious to those skilled in the art that modifications may be made to the embodiment of the invention described above without departing from the scope of the invention. For example, more or less than five chambers might be used. Also, the door for access to the fill ports need not be at the top of the machine. Further, the channels for the lower chambers could extend along the side of the respective upper chambers rather than behind the upper chambers. While a single fill access door and a single coin collection door are shown, it may be desirable to have more than one door, each door accessing a number of fill ports or coin collection boxes. These and other modifications will be obvious to those skilled in the art.

I claim:

1. A multi-chamber automated vending machine comprising:

an outer housing;

an upper chamber and a lower chamber inside the housing, each of said chambers being adapted to hold a flowable body of merchandise items, each of said chambers having a filling port for introducing the merchandise items into the chamber and a dispensing port for dispensing the respective items to the outside of the chamber;

said upper chamber having a bottom wall and a plurality of vertically extending walls;

said lower chamber surrounding a portion of the bottom wall of the upper chamber and a portion of a vertically extending wall of the upper chamber;

automated vending means responsive to payment positioned in each of the chambers in the lower portion thereof which are separately operable;

door means connected to the housing providing an entry into the interior of the housing, whereby the filling ports for both chambers may be accessed by opening the door means;

wherein both of the chambers have associated therewith coin operated triggering means for controlling the vending of the merchandise in response to coin payment, each of said triggering means having a coin receptacle for receiving coins from outside the chamber and a coin pathway which directs coins to a coin storage area which is below both of the chambers; and the coin pathway for the triggering means for the upper chamber communicates between the coin receptacle for the upper chamber and the storage area, and extends downward past at least the upper portion of said bottom chamber to the coin storage area.

2. The vending machine of claim 1, wherein the coin storage area comprises a plurality of horizontally spaced coin collection boxes, and there is a lockable door enclosure mounted on the outer housing for securing and accessing the coin storage area.

* * * * *